US006568081B2

(12) United States Patent
Barish

(10) Patent No.: US 6,568,081 B2
(45) Date of Patent: May 27, 2003

(54) SHAVING APPARATUS PARTICULARLY USEFUL FOR WET SHAVING WITH AN ELECTRICAL SHAVER

(76) Inventor: Benjamin J. Barish, 36 Yehuda Hanassi, 69206 Tel Aviv (IL)

( * ) Notice: Subject to any disclaimer, the term of this patent is extended or adjusted under 35 U.S.C. 154(b) by 0 days.

(21) Appl. No.: 09/887,027

(22) Filed: Jun. 25, 2001

(65) Prior Publication Data

US 2001/0042308 A1 Nov. 22, 2001

(51) Int. Cl.[7] ..... B26B 19/42
(52) U.S. Cl. ..... 30/34.2; 30/43.6
(58) Field of Search ..... 30/34.2, 43.6

(56) References Cited

U.S. PATENT DOCUMENTS 2,223,286 A 11/1940 Johnson
3,768,160 A 10/1973 Bergsma et al.
3,992,775 A 11/1976 De Vries
5,621,971 A 4/1997 Szymansky
5,625,950 A 5/1997 Sterk et al.
5,687,481 A 11/1997 De Boer et al.
6,317,983 B1 * 11/2001 Kakimoto ..... 30/34.2

* cited by examiner

*Primary Examiner*—Douglas D. Watts

(57) ABSTRACT

An electrical shaver particularly useful for wet shaving includes a manually-grippable housing, and a cutter head removably attachable thereto along the outer edge of the cutter head. The cutter head includes at least one relatively sharp scraper edge located between the outer side of at least one cutter unit and the outer edge of the cutter head, but does not extend to the inner side of the cutter unit facing an adjacent cutter unit, such that the scraper edge is pressable into the skin, forwardly of the respective cutter unit, to erect hairs in the skin and to tauten the skin in advance of the respective cutter unit, with minimal irritation of the skin, as the cutter head is moved across the skin in the direction from the outer side towards the inner side of the respective cutter unit.

20 Claims, 3 Drawing Sheets

SHAVING APPARATUS PARTICULARLY USEFUL FOR WET SHAVING WITH AN ELECTRICAL SHAVER

RELATED APPLICATIONS

The present application is related to application Ser. No. 09/644,583 filed Aug. 24, 2000, which in turn is a Continuation-in-Part of application Ser. No. 09/312,765 filed May 17, 1999, now U.S. Pat. No. 6,226,870.

FIELD AND BACKGROUND OF THE INVENTION

The present invention relates to shaving apparatus. The invention is particularly applicable to electrical shavers of the type including one or more rotary cutter members driven by an electrical motor, and is therefore described below with respect to such shavers.

For many years two basically different techniques have been used for shaving: (a) the "wet shave", using a razor blade (straight blade or safety blade) and soap, lather, or a shaving cream for lubricating the skin and/or softening the hairs; and (b) the "dry shave", using an electrical shaver on a dry skin. The main advantages of the "wet shave" are the ability of obtaining a close shave, the refreshing after-feeling produced after the shave, and the convenience of cleaning the shaver by merely rinsing the blade. The main advantages of the "dry shave" are the convenience of shaving almost whenever and wherever desired, the reduced danger of nicking, cutting or irritating the skin, and the elimination of the expense of frequent blade replacement since electrical shavers are generally self-sharpening during use.

Recently, several manufacturers have introduced electrical shavers for wet shaving. One type of electrical shaver is advertised for use with soap and water; whereas another type is advertised for use with an emulsion cream and includes a dispenser for dispensing the cream during use.

I have noted that when an electrical shaver is used for wet shaving, whether with soap and water, an emulsion cream, or other substance for lubricating the skin, the lubricating substance also wets the hairs in the skin, and therefore the shaver head tends to glide over the hairs. As a result, it fails to pick-up or closely cut some hairs such that the shave tends to be less close than with a blade.

OBJECTS AND BRIEF SUMMARY OF THE INVENTION

An object of the present invention is to provide a shaver having advantages in the above respects. Another object of the invention is to provide an electrical shaver particularly adaptable for wet shaving.

According to the present invention, there is provided a shaver particularly useful for wet shaving hair from skin, comprising: a manually-grippable housing; and a cutter head carried by the housing and removably attachable thereto along the outer edge of the cutter head; the cutter head having a shaving face carrying a plurality of cutter units to be pressed into contact with, and to be moved along, the skin to be shaved; each of the cutter units having an inner side facing an adjacent cutter unit, and an outer side facing the outer edge of the cutter head. The novel shaver is characterized in that the cutter head further includes at least one relatively sharp scraper edge located between the outer side of at least one cutter unit and the outer edge of the cutter head so as to be pressable into the skin, forwardly of the respective cutter unit, to erect hairs in the skin and to tauten the skin in advance of the respective cutter unit as the cutter head is moved across the skin in the direction from the outer side towards the inner side of the respective cutter unit. The relatively sharp scraper edge does not extend to the inner side of the respective cutter unit facing its adjacent cutter unit so as to minimize possible irritation of the skin as the cutter head is moved across the skin.

An electrical shaver provided with a such a relatively sharp scraper edge may thus be used to engage and erect the hairs in advance of the cutter unit, and also to tauten the skin before engaged by the cutter unit, in a manner similar to the action of the two-blade or three-blade safety razor. Such a shaver thereby better assures a cleaner and closer shave than heretofore normally obtainable with an electrical shaver.

In the described preferred embodiments, the relatively sharp scraper edge is formed in a hard, low-friction material, such as hard plastic, metal, or metal-plated plastic.

According to a further feature in the preferred embodiments of the invention described below, the relatively sharp scraper edge is located on the cutter head such that the relatively sharp scraper edge is pressed into the skin to erect the hairs, and to tauten the skin, by tilting the cutter head with respect to the skin to bring the axis of the cutter head to an oblique angle with respect to the skin. Such a feature enables the user to render the scraper edge effective only when desired, by merely tilting the shaver with respect to the skin to be shaved, thereby further minimizing the possibility of irritating the skin by the scraper edge when a scraping action is not needed.

Several embodiments of the invention are described below for purposes of example.

In some described embodiments, each of the cutter units is circumscribed by a skin engaging surface of the shaver. In these described embodiments, the skin engaging surface has an inner side face facing the respective cutter unit, an outer side face facing away from the respective cutter unit, and an outer skin-contact face joining the inner and outer side faces; the relatively sharp scraper edge being formed in the juncture of the outer skin-contact face with the outer side face. In one of the latter embodiments, the relatively sharp scraper edge is defined by a sharp corner at this juncture, whereas in another described embodiment, it is defined by an outward extension of the skin-contact face at this juncture.

In some described embodiments of the latter feature, the skin engaging surface is in the form of a rim circumscribing each cutter unit; preferably, each of the rims includes an outer face formed with the relatively sharp scraper edge, and an inner face formed with a recess defining a gap with respect to the cutter unit to enhance the tautening of the skin in advance of the cutter unit. In another described embodiment, the skin engaging surface is in the form of a flat table within which all the cutter units are located, the scraper edge being formed in the outer face of the table.

A still further embodiment is described wherein the relatively sharp scraper edge is formed in the cutter head between the outer edge of the cutter head and two adjacent cutter heads and bridges the space between the two adjacent cutter heads. In this described embodiment, the relatively sharp scraper edge is formed in a slanted peripheral margin of the cutter head between the shaving face and the outer edge of the cutter head such that the relatively sharp scraper edge does not contact the skin being shaved during a normal shaving operation when the shaving face of the cutter head is pressed against the skin being shaved, but is brought into contact with the skin to erect the hairs and tauten the skin by tilting the cutter head to bring the axis of the cutter head to an oblique angle with respect to the skin.

Further features and advantages of the invention will be apparent from the description below.

BRIEF DESCRIPTION OF THE DRAWINGS

The invention is described below with respect to the accompanying drawings, wherein.

DESCRIPTION OF PREFERRED EMBODIMENTS

FIGS. 1–4 illustrate an electrical shaver of the rotary type as widely sold by Philips Corporation and having features described, for example, in their U.S. Pat. No. 5,625,950, which description is hereby incorporated herein by reference. The particular shaver illustrated is the Philips "Philishave Cool Skin" model which includes a built-in dispenser for dispensing an emulsion cream during shaving.

Figure 1:
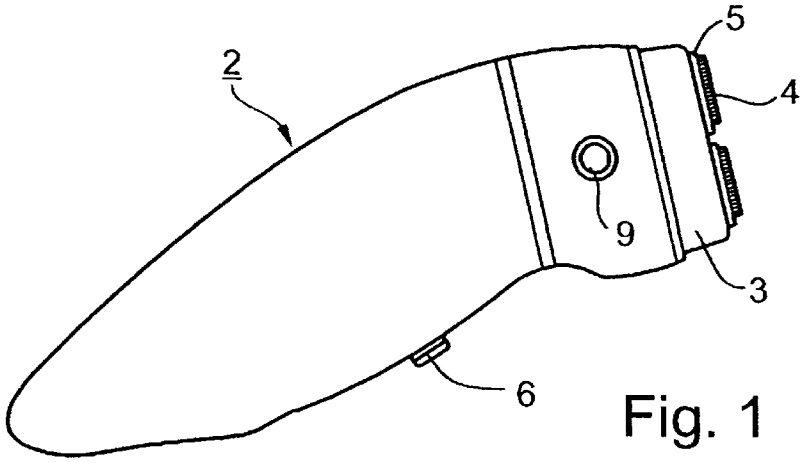
FIG. 1 illustrates one form of rotary-type electrical shaver constructed in accordance with the present invention.
Figure 2:
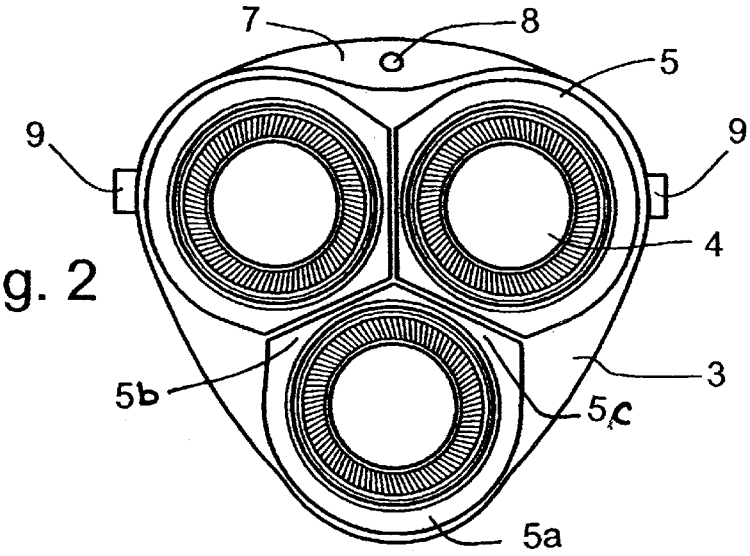
FIG. 2 is a front plan view illustrating the cutter head in the electrical shaver of FIG. 1.

The illustrated electrical shaver includes a manually-grippable housing, generally designated 2, having a cutter head 3 at one end removably attachable to the housing along the outer edge of the cutter head. The cutter head 3 has a shaving face carrying a plurality of cutter units 4, in this case three cutter units arranged in a triangular array as shown in FIG. 2, to be pressed into contact with, and to be moved along, the skin to be shaved. Each cutter unit 4 is circumscribed by a skin engaging surface in the form of a rim 5 which engages and supports the skin during the shaving operation.

Figure 4:
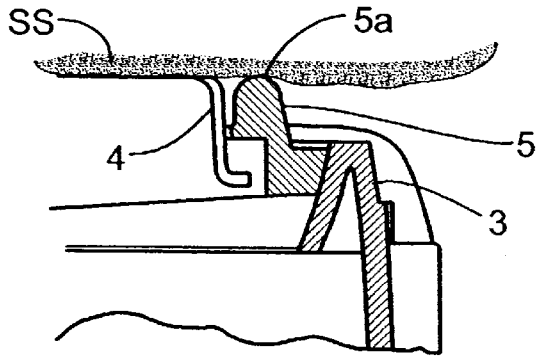
Fig. 4 (Prior Art)
FIG. 4 is a view corresponding to that of FIG. 3, but showing the skin-engaging position of the cutter unit during shaving.

As known in such electrical shavers, each cutter unit 4 includes an external cutter member formed with a plurality of hair-entry slits, and an inner cutter member rotatable within the outer cutter member to cut the hairs received within the hair-entry slits. Each cutter unit 4 is depressible within the skin supporting rim 5 during the shaving operation, as shown in FIG. 4, to slightly tauten the skin before engaged by the cutter unit 4.

The shaver illustrated in FIGS. 1–4 further includes a push-button switch 6 for operating an electrical motor within housing 2, and a dispenser section 7 for dispensing a small quantity of cream via an opening 8 upon manual depression of either of two side buttons 9.

Such electrical shavers are well known and widely available on the market in various models, with or without the cream dispenser. Accordingly, further details of the construction and operation of the electrical shaver illustrated in FIGS. 1–4 are not set forth herein.

Figure 3:
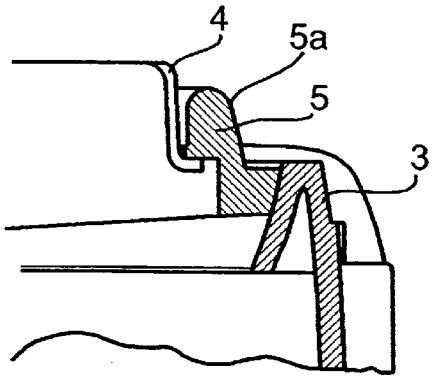
Fig. 3 (Prior Art)
FIG. 3 is an enlarged fragmentary view, partly in section, illustrating the present construction of the cutter head in the normal, skin-disengaged, position of the respective cutter unit.

In the commercial models of such shavers, and as clearly illustrated in the above-cited U.S. Pat. No. 5,625,950, the skin supporting rim 5 around each of the cutter units 4 has a substantially circular section 5*a* facing outwardly of the cutter head, and two straight sections 5*b*, 5*c* facing inwardly adjacent the other two cutter units 4. The skin supporting rims 5, together with their respective cutter units 4, are pivotally mounted to each other along their inner sections 5*b*, 5*c* to permit them, and their respective cutter units, to conform to the curvature of the face being shaved. The outer circular sections 5*a* of the supporting rims 5 have rounded outer faces, as shown in FIGS. 3 and 4, to minimize the resistance of the movement of the cutter head across the surface to be shaved during a shaving operation.

Figure 5:
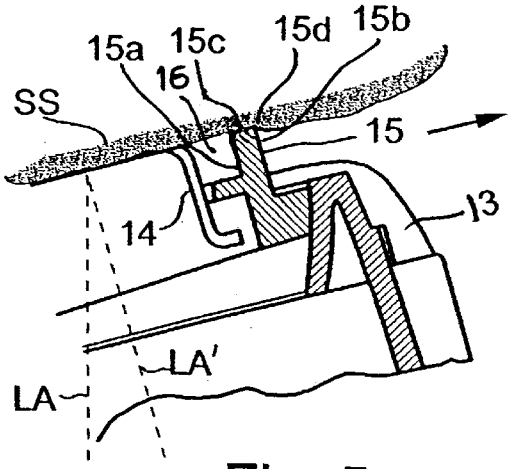
FIG. 5 is a view corresponding to that of FIG. 4 but showing a modification in the construction of the shaver head to incorporate a relatively sharp scraper edge in accordance with one embodiment of the present invention'

FIG. 5 is a view corresponding to that of FIG. 4 but illustrating the present invention implemented as a modification in the construction of the skin supporting rim (5, FIGS. 1–4). In the modification illustrated in FIG. 5, the cutter head 13 also includes three cutter units 14 (only the outer cutter member of one cutter unit being shown) circumscribed by a skin supporting rim 15. In this case, however, the outer circular section of the skin supporting rim 15 (corresponding to section 5*a* in FIG. 2) is formed with a relatively sharp scraper edge located so as to be pressed into the skin SS to be shaved forwardly of the respective cutter unit 14, to erect hairs in the skin and to tauten the skin, in advance of the respective cutter unit as the cutter head 13 is moved across the skin. It is to be particularly noted that the relatively sharp scraper edge does not extend to the inner side of the respective cutter unit 14 facing its adjacent cutter unit. The inner straight sections of the rim (corresponding to sections 5*b*, 5*c* in FIG. 2) facing the adjacent cutter units 4 are thus devoid of a relatively sharp scraper edge, but rather present a substantially flush surface, to minimize possible irritation of the skin as the cutter head is moved across the skin.

More particularly, as shown in FIG. 5, the outer circular section of each skin supporting rim 15 (corresponding to section 5*a* in FIG. 2) includes an inner side face 15*a* facing its respective cutter unit 14, an outer side face 15*b* facing away from the cutter unit (i.e., facing the outer edge of the cutter head 13), and an outer skin-contact face 15*c* joining the two side faces 15*a*, 15*b* to contact and support the skin SS when the cutter unit is pressed inwardly during shaving. In the embodiment illustrated in FIG. 5, the relatively sharp scraping edge is defined by a sharp corner 15*d* at the juncture of the outer skin-contact face 15*c* and the outer side face 15*b* of the skin supporting rim 15.

Preferably, the outer tip of the scraping edge defined by the sharp corner 15*d* is substantially flush with the skin-contact face 15*c* of the skin supporting rim 5, or recessed slightly inwardly of that surface, so that the sharp edge will not be pressed significantly into the skin during a normal shaving operation when the axis of the shaver unit is perpendicular to the skin SS to be shaved. This minimizes irritating the skin by the sharp edge during a normal shaving operation. As indicated earlier, skin irritation is also minimized by the fact that the inner side of each cutter unit 4 facing its adjacent cutter unit is devoid of a relatively sharp scraper edge. When it is desired to make the scraper edge 15*d* effective to scrape the skin, the electrical shaver would be tilted slightly with respect to the skin SS to bring the longitudinal axis of the cutter unit 14 to an oblique position. This would produce the scraping action which erects the hairs and tautens the skin in advance of the cutter unit, as the cutter head is moved across the skin in the direction from the outer side towards the inner side of the respective cutter unit 4.

In FIG. 5, the normal position of the shaver unit is indicated by its longitudinal axis LA, and the tilted position is indicated by its longitudinal axis LA'. Thus, during a normal shaving operation, the shaver would be oriented with its longitudinal axis LA substantially perpendicular to the skin as the shaver is pressed against the skin. When a scraping action is desired, the shaver could be tilted to bring its longitudinal axis to the tilted position, shown at LA', with respect to the skin. Such an arrangement thus enables the scraper edge to be selectively activated to perform its scraping function as and when desired, with a minimum of irritation of the skin during normal shaving when the cutter head is pressed perpendicularly against the skin.

As also shown in FIG. 5, the inner face of the skin supporting rim 15 is formed with an annular recess defining a space or gap 16 with respect to the cutter unit 14. This gap better permits the skin therein to stretch and thus enhances the tautening of the skin in advance of the cutter unit when the scraper edge 15*d* is pressed into the skin as described above.

Figure 6:
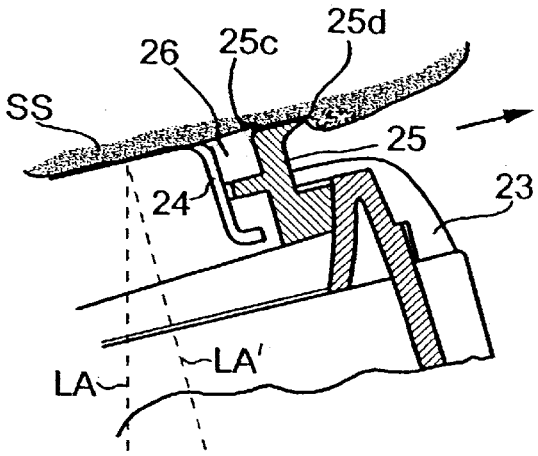
FIG. 6 is a view corresponding to that of FIG. 5 but illustrating a second embodiment of the present invention.

FIG. 6 illustrates a construction similar to that of FIG. 5, also including a holder 23, cutter unit 24 and skin supporting rim 25, corresponding to elements 13, 14 and 15, respectively in FIG. 5. In the modification of FIG. 6, however, the relatively sharp scraper edge is defined by an outward extension 25*d* of the outer skin-contact face 25*c* of the skin supporting rim 25 at the juncture of that outer skin-contact face with the outer side face 25*b* of the rim.

As in FIG. 5, the outer tip of the scraper edge 25*d* could also be substantially flush with, but preferably is slightly inwardly recessed with respect to, the contact face 25*c* of the rim 25. In this embodiment, as well as in the embodiment of FIG. 5, the outer skin-contact face 25*c* may also be slightly rounded so as to produce a minimum of irritation of the skin during normal shaving operation, but to permit the scraper edge to become effective to erect the hairs and to tauten the skin, whenever desired, by merely slightly tilting the electrical razor obliquely as described above with respect to FIG. 5. The inner face of the rim 25 in FIG. 6 is also provided with a recess to define a space or gap 26 for enhancing the tautening of the skin as described above with respect to FIG. 5.

In all other respects, the construction of the cutter head illustrated in FIGS. 5 and 6 is otherwise the same as described in the above-cited U.S. Pat. No. 5,625,950 incorporated herein by reference.

Each of the skin engaging rims, 15 in FIG. 5 and 25 in FIG. 6, is preferably made of a hard, low-friction material, such as a hard plastic, a metal, (e.g., aluminum), or a metal-plated plastic, so that the scraper edge formed therein will also be of a hard, low-friction material. Such scraper edges, therefore, minimize the irritation of the skin while erecting the hairs and tautening the skin during a shaving operation. Skin irritation is also minimized or eliminated by the use of soap and water, a lather, emulsion cream, or the like, for lubricating the skin when using the electric shaver for wet shaving.

Figure 7:
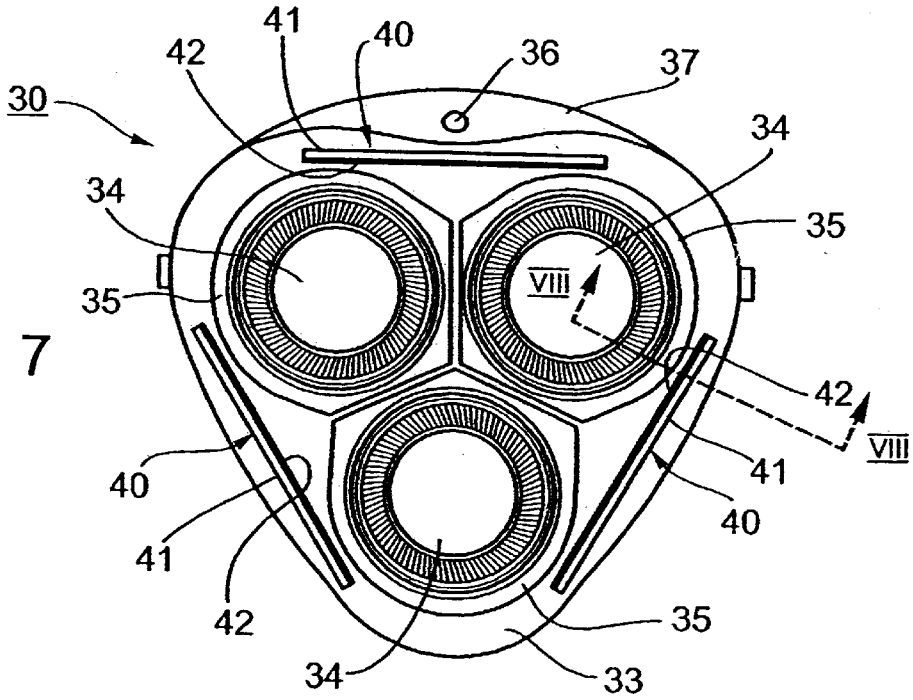
FIG. 7 is a view corresponding to that of FIG. 2 but illustrating a third embodiment of the invention.
Figure 8:
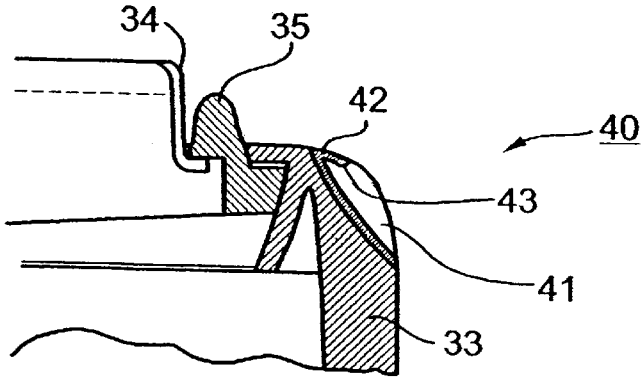
FIG. 8 is an enlarged fragmentary view along line VIII—VIII of FIG. 7.
Figure 9:
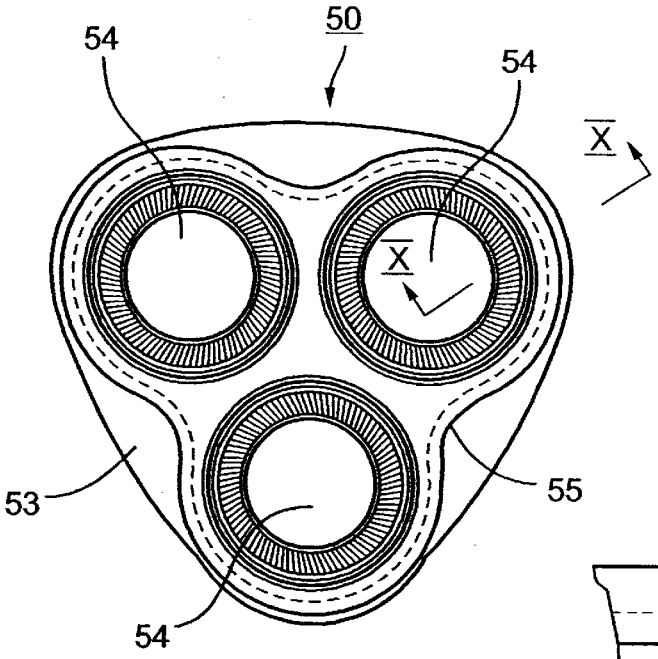
FIG. 9 is a front plan view illustrating another type of rotary-electrical shaver.

FIG. 7, and its sectional view shown in FIG. 8, illustrate another electrical shaver 30 constructed in accordance with the present invention wherein the relatively sharp scraping edge is formed in the cutter head 33 between the skin engaging rims 35 circumscribing the cutter units 34 and the outer edge of the cutter head. Thus, as shown in FIGS. 7 and 8, each cutter unit 34 is also circumscribed by a skin supporting rim 35, which in this case may be of the conventional configuration described for example in the above-cited U.S. Pat. No. 5,625,950. Here, however, the relatively sharp scraper edge feature, generally designated 40, is formed in the cutter head 33 outwardly of the rims 35, i.e., between the rims of the cutter units and the outer edge of the cutter head.

The cutter head 33 in FIG. 7 includes three cutter units 34 arranged in a triangular array; and the holder 33 incorporates three such relatively sharp scraping edge formations 40 along each side of the triangular array such that each bridges two cutter units at the respective side.

In the present commercial version of the electrical shaver, the cutter head 33 is made of a plastic material and includes a slanted, rounded peripheral margin between the shaving face carrying the cutter units 44 and the outer edge of the cutter head. Each of the relatively sharp scraper formations 40 may thus be formed by producing an elongated groove or recess 41 in the slanted peripheral margin of the cutter head 33, and inserting an elongated blade-like metal insert 42 into the recess, which insert is formed with a relatively sharp edge 43 projecting over the recess 41 to define the scraper edge. Where the cutter head is of metal, a similar recess and projection may be integrally formed in the metal of the cutter head, and the metal of the cutter head may be formed with the relatively sharp scraper edge 42 projecting over the recess.

In the embodiment illustrated in FIGS. 7 and 8, the scraper edge 43 is thus normally out of contact with the skin to be shaved and therefore cannot engage or irritate the skin during a normal shaving operation. Whenever it is desired to effect a scraping action, the electrical shaver would be pivoted to an oblique position, as described earlier, to bring the relatively sharp scraper edge 43 into contact with the skin being shaved, and thereby to erect the hairs and to tauten the skin in advance of the cutter units 34. For example, such a tilting could be effected by a rolling movement of the user's hand grasping the electrical shaver at the beginning of selected shaving strokes.

Thus, the embodiment illustrated in FIGS. 7 and 8 reduces the possibility of irritating the skin during a normal shaving operation, but it tends to tauten the skin to a lesser degree just before engaged by the cutter units, than the earlier described embodiments.

FIGS. 9–12 illustrate further embodiments wherein the invention is implemented in another type of rotary electrical shaver, also including a cutter head 53 mounting three cutter units 54 in a triangular array within a skin engaging and supporting surface 55. In this case, however, the skin engaging and supporting surface 55 is not in the form of an individual rim circumscribing each of the cutter units, as described above, but rather is in the form of a slightly elevated table which is common to all the cutter units 54.

Figure 10:
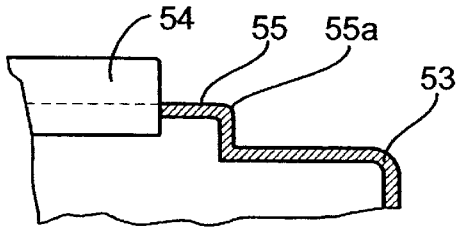
Fig. 10 (Prior Art)
FIG. 10 is an enlarged fragmentary view along line X—X of FIG. 9 illustrating a prior art construction of such an electrical shaver.

FIG. 10 illustrates a known prior art construction of such electrical shavers, wherein it will be seen that the skin supporting table 55 has a flat upper surface in contact with the skin, but is provided with a rounded forward surface 55*a* so as to facilitate movement of the cutter head over the skin being shaved with a minimum of irritation.

Figure 11:
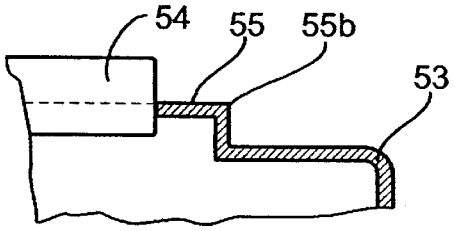
FIG. 11 is a view corresponding to that of FIG. 10 but illustrating a modification in the construction of the cutter head in accordance with another embodiment of the present invention.
Figure 12:
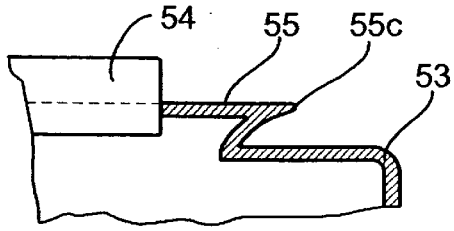
FIG. 12 is a view corresponding to that of FIG. 11 but illustrating a modification in accordance with yet another embodiment of the present invention.

FIGS. 11 and 12 illustrate two manners of modifying the construction of such an electrical shaver in accordance with the present invention to provide a relatively sharp scraper edge on the cutter head 53 to be pressed into the skin forwardly of the cutter units in order to erect hairs in the skin, and to tauten the skin, in advance of the cutter units, as described above with respect to FIGS. 5–8.

FIG. 11 illustrates a construction similar to that in FIG. 5 wherein the relatively sharp scraper edge, shown at 55*b,* is defined by a sharp corner in the outer edge of the skin supporting table 55; whereas FIG. 12 illustrates a construction similar to that of FIG. 6, wherein the relatively sharp scraper edge, shown at 55*c,* is defined by an outward extension of the outer contact face of the skin supporting table 55 with its outer side face. It will be appreciated that either or both of the above constructions could be provided with recesses around each of the cutter units 54 to define gaps corresponding to gaps 16 and 26 in FIGS. 5 and 6 to enhance the skin-tautening function of the scraper edge as described above with respect to FIGS. 5 and 6.

While the invention has been described above with respect to one particular type of rotary electric shaver, it will be appreciated that it could be implemented in many other types of shavers, including also the oscillatory type shavers. To better enable its use with soap and water or while showering, it could be implemented in an electrical shaver having a magnetic coupling between the electrical motor and the shaver units, as described for example in my U.S. Pat. No. 6,226,870, or in my co-pending patent application Ser. No. 09/610,467, filed Jul. 5, 2000. It could also be included in an attachment for electrical shavers as described in my pending application Ser. No. 09/718,347 filed Nov. 24, 2000. Another possible implementation would be in dry electrical shavers, particularly one having the air impeller feature described in my U.S. Pat. No. 5,909,928, in order to provide the above-described hair erecting and skin-tautening advantages also for such dry electrical shavers.

Many other variations, modifications and applications of the invention will be apparent.

What is claimed is:

1. A shaver particularly useful for shaving hair from skin, comprising: a manually-grippable housing; and a cutter head carried by said housing and removably attachable thereto along an outer edge of the cutter head; said cutter head having a shaving face carrying a plurality of cutter units to be pressed into contact with, and to be moved along, the skin to be shaved; each of said cutter units having an inner side facing an adjacent cutter unit, and an outer side facing the outer edge of said cutter head;

characterized in that said cutter head further includes at least one relatively sharp scraper edge located between the outer side of at least one cutter unit and the outer edge of the cutter head so as to be pressable into the skin forwardly of the respective cutter unit, to erect hairs in the skin and to tauten the skin in advance of the respective cutter unit as the cutter head is moved across the skin in the direction from the outer side towards the inner side of the respective cutter unit; said relatively sharp scraper edge not extending to the inner side of the respective cutter unit facing its adjacent cutter unit so as to minimize possible irritation of the skin as the cutter head is moved across the skin.

2. The shaver according to claim 1, wherein said relatively sharp scraper edge is formed in a hard, low-friction material.

3. The shaver according to claim 1, wherein said relatively sharp scraper edge is located on said cutter head such that the relatively sharp scraper edge is pressed into the skin to erect the hairs, and to tauten the skin, by tilting the cutter head with respect to said skin to bring the axis of the cutter head to an oblique angle with respect to said skin.

4. The shaver according to claim 1, wherein each of said cutter units is circumscribed by a skin-engaging surface of said shaving face; said skin engaging surface having an inner side face facing the respective cutter unit, an outer side face facing away from the respective cutter unit, and an outer skin-contact face joining said inner and outer side faces; said relatively sharp scraper edge being formed in the juncture of said outer skin-contact face with said outer side face.

5. The shaver according to claim 4, wherein said relatively sharp scraper edge is defined by a sharp corner at said juncture.

6. The shaver according to claim 4, wherein said relatively sharp scraper edge is defined by an outward extension of said outer skin-contact face at said juncture.

7. The shaver according to claim 4, wherein said skin engaging surface is in the form of a rim circumscribing each cutter unit.

8. The shaver according to claim 7, wherein each of said rims includes an outer face formed with said relatively sharp scraper edge, and an inner face formed with a recess defining a gap with respect to said cutter unit to enhance said tautening of the skin.

9. The shaver according to claim 4, wherein said skin-engaging surface is in the form of a flat table within which all said cutter units are located, said scraper edge being formed in the outer face of said table.

10. The shaver according to claim 1, wherein said relatively sharp scraper edge is formed in said cutter head between the outer edge of the cutter head and two adjacent cutter units, and bridges the space between the two adjacent cutter units.

11. The shaver according to claim 10, wherein said relatively sharp scraper edge is defined by a relatively sharp projection extending over a recess formed in said cutter head between said relatively sharp projection and the outer edge of the holder.

12. The shaver according to claim 11, wherein said cutter head is of a plastic material, and said relatively sharp projection defining said scraper edge is a metal insert seated within said recess.

13. The shaver according to claim 10, wherein said relatively sharp scraper edge is of a linear configuration.

14. The shaver according to claim 10, wherein said cutter head includes three cutter units arranged in a triangular array, and said relatively sharp scraper edge is formed in said cutter head at least along one of the three sides of said triangular array.

15. The shaver according to claim 14, wherein said cutter head includes a relatively sharp scraper edge along each of the three sides of said triangular array.

16. The shaver according to claim 10, wherein said relatively sharp scraper edge is formed in a slanted peripheral margin of the cutter head between said shaving face and the outer edge of the cutter head such that the relatively sharp scraper edge does not contact the skin being shaved during a normal shaving operation when the shaving face of the cutter head is pressed against the skin being shaved, but is brought into contact with the skin to erect the hairs and tauten the skin by tilting the cutter head to bring the axis of the cutter head to an oblique angle with respect to the skin.

17. The shaver according to claim 1, wherein said relatively sharp scraper edge is a low-friction, hard plastic.

18. The shaver according to claim 1, wherein said relatively sharp scraper edge is a low-friction metal.

19. The shaver according to claim 1, wherein said relatively sharp scraper edge is a metal-plated plastic.

20. The shaver according to claim 1, wherein each of said cutter units includes an outer cutter member formed with a plurality of hair-entry slits, and an inner cutter member rotatable within said outer cutter member to cut the hairs received within said hair-entry slits.

* * * * *